US010226136B2

(12) United States Patent
Cohn

(10) Patent No.: US 10,226,136 B2
(45) Date of Patent: Mar. 12, 2019

(54) DEVICE FOR ASSISTING CHILDREN LEARNING TO WALK

(71) Applicant: Gabriel Cohn, Novato, CA (US)

(72) Inventor: Gabriel Cohn, Novato, CA (US)

( * ) Notice: Subject to any disclaimer, the term of this patent is extended or adjusted under 35 U.S.C. 154(b) by 0 days.

(21) Appl. No.: 15/171,797

(22) Filed: Jun. 2, 2016

(65) Prior Publication Data

US 2016/0354274 A1 Dec. 8, 2016

Related U.S. Application Data

(60) Provisional application No. 62/170,139, filed on Jun. 3, 2015.

(51) Int. Cl.
*A47D 13/04* (2006.01)

(52) U.S. Cl.
CPC ..... *A47D 13/04* (2013.01)

(58) Field of Classification Search
CPC ..... A47D 13/04; A47D 13/046; A63B 7/00; A63B 7/02; A63B 7/04; A63B 21/0004; A63B 21/00043; A63B 21/00058; A63B 21/00069; A63B 21/00072; A63B 21/00076; A63B 21/00178; A63B 21/00181; A63B 21/00185; A63B 21/002; A63B 21/023; A63B 21/02; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/065; A63B 21/068; A63B 21/08; A63B 21/15; A63B 21/151; A63B 21/159; A63B 21/16; A63B 21/28; A63B 21/285; A63B 21/4017; A63B 21/4019; A63B 21/4023; A63B 21/4025; A63B 21/4033; A63B 21/4035; A63B 21/4039; A63B 21/4043; A63B 21/4045; A63B 21/4047; A63B 21/4049; A63B 23/035; A63B 23/03516; A63B 23/03533; A63B 23/03541; A63B 23/03575; A63B 23/04; A63B 23/0405; A63B 23/0482; A63B 23/0494; A63B 23/12; A63B 23/1209; A63B 23/1245; A63B 23/1281; A63B 26/00; A63B 23/003; A63B 69/0028; A63B 69/0035; A63B 69/0057; A63B 69/0059; A63B 69/0064;

(Continued)

(56) References Cited

U.S. PATENT DOCUMENTS 2,956,616 A * 10/1960 Labusky ..... A47D 13/04 280/87.051
3,215,429 A * 11/1965 Shaboo ..... A63B 21/0004 482/125

(Continued)

*Primary Examiner* — Gary D Urbiel Goldner
(74) *Attorney, Agent, or Firm* — Lyman Smith; Patent Service Associates

(57) ABSTRACT

A device assists infants and toddlers while they learn to walk while preventing posture fatigue for the parent or caregiver of the infants and toddlers. The device includes a crossbar for the parent or caregiver to hold on to and two rings for the infants and toddlers to grasp. The rings can adjust in their distance from the crossbar and are attached to the crossbar via a rope or webbing. The device requires no straps or harnesses and is easily collapsible and portable.

16 Claims, 3 Drawing Sheets

(58) Field of Classification Search
CPC ..... A63B 71/0054; A63B 2208/02; A63B 2208/0204; A63B 2208/0285; A63B 2208/029; A63B 2225/09; A63B 2225/093
See application file for complete search history.

(56) References Cited

U.S. PATENT DOCUMENTS 3,237,939 A * 3/1966 Olivet ..... A47D 13/046 482/69
3,256,015 A * 6/1966 Perrin ..... A63B 21/04 24/129 C
3,910,573 A * 10/1975 Jamba ..... A63B 21/0023 482/91
5,120,287 A * 6/1992 Brown ..... A47D 13/046 119/770
5,125,649 A * 6/1992 Fuller ..... A63B 21/0004 482/106
5,131,650 A * 7/1992 Hall ..... A63B 21/0552 482/122
D360,855 S * 8/1995 Jameson ..... D12/130
5,498,219 A * 3/1996 Soufi ..... A47D 13/046 434/255
6,196,949 B1 * 3/2001 Rodarte ..... A47D 13/04 434/255
6,544,152 B2 * 4/2003 Rosati ..... A63B 21/055 482/126
6,827,672 B2 * 12/2004 Miceli ..... A47D 13/046 482/43
6,979,286 B1 * 12/2005 Hinds ..... A63B 21/0552 482/121
6,988,978 B1 * 1/2006 Nault ..... A63B 21/0552 482/121
7,090,627 B1 * 8/2006 Walker ..... A63B 21/055 482/121
7,357,762 B1 * 4/2008 Terry ..... A63B 21/0552 482/121
7,578,775 B2 * 8/2009 Terry ..... A63B 21/0004 482/121
7,922,634 B1 * 4/2011 Wu ..... A63B 21/0004 482/121
8,038,584 B1 * 10/2011 Pruessner ..... A61H 1/02 482/143
8,303,471 B2 * 11/2012 Musachio ..... A63B 21/0004 24/298
8,348,814 B1 * 1/2013 Hinds ..... A63B 7/02 482/82
9,254,405 B1 * 2/2016 Marji ..... A63B 21/02
2003/0236154 A1 * 12/2003 Miceli ..... A47D 13/046 482/69
2005/0059537 A1 * 3/2005 Hull ..... A63B 21/0004 482/124
2007/0232449 A1 * 10/2007 Planke ..... A61H 1/0218 482/1
2007/0254786 A1 * 11/2007 Owen ..... A63B 21/0552 482/121
2008/0293545 A1 * 11/2008 Planke ..... A63B 7/00 482/7
2010/0275958 A1 * 11/2010 Kasurinen ..... A63B 21/0004 135/66
2011/0003669 A1 * 1/2011 Planke ..... A63B 21/00196 482/139
2012/0035031 A1 * 2/2012 Silverman ..... A63B 7/00 482/139
2012/0329618 A1 * 12/2012 White ..... A63B 21/0552 482/126
2012/0329620 A1 * 12/2012 White ..... A63B 21/151 482/131
2013/0165301 A1 * 6/2013 Thrasher-Rudd ..... A63B 7/00 482/129
2015/0366741 A1 * 12/2015 Ropes ..... A47D 13/04 482/69
2016/0324714 A1 * 11/2016 Jung ..... A63B 69/0064

* cited by examiner

DEVICE FOR ASSISTING CHILDREN LEARNING TO WALK

CROSS-REFERENCE TO RELATED APPLICATIONS

This application claims the benefit of priority to U.S. provisional patent application No. 62/170,139, filed Jun. 3, 2015, the contents of which are herein incorporated by reference.

BACKGROUND OF THE INVENTION

1. Field of the Invention

One or more embodiments of the invention relates generally to support devices. More particularly, the invention relates to devices for parents or caregivers for children learning to walk.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Children often instinctively will reach for a parent's hand or fingers to help balance themselves while walking. However, the parent, due to the limited reach of the child, has to bend over and remain bent over while walking with the child.

Other inventions have attempted to solve this problem by using harnesses and other complex devices. These inventions require preparation and setup before then can be used. Some of the conventional devices are not portable. Some conventional devices do not allow the child to balance on their own, as they provide much more support.

In view of the foregoing, it is clear that these traditional devices are not perfect and leave room for more optimal approaches.

SUMMARY OF THE INVENTION

The present invention was developed to save parents from having to bend over to hold a child's hands while the child is learning to walk. The present invention also helps the child develop grasping and hand-eye coordination skills as they locate and grasp a pair of rings. As the support that the device lends is limited and allows the child to make his or her own corrections by shifting his or her weight, the present invention also aids the child in developing balance. The present invention is easy to use, portable, collapsible and requires no attachments, straps, or harnesses.

As a child learns to walk, they often require support in the form of a couch or a coffee table or a parent's hands. The option of using the parent's hands is often preferred by the child, but the act of walking around in a hunched over position can be painful on the parent's back. The invention solves this by using a crossbar and rings attached by rope or webbing, allowing the parent to stand in a normal upright position while still assisting the child in learning to walk.

Furthermore, the invention helps the child develop grasping skills and hand-eye coordination as the child locates and grasps the ring. The parent can assist in this process as well, but parental assistance is not necessary.

Finally, the invention helps the child improve his or her balance. Because the invention is not a rigid device, the child is constantly shifting his or her weight in order to continue walking, strengthening core muscles and improving balance.

Embodiments of the present invention provide a walking child support device comprising a crossbar having a central region and ends extending from the central region; a left-side outer hole extending through the crossbar on a left-side end thereof; a right-side outer hole extending through the crossbar on a right-side end thereof; a left-side inner hole adjacent a left side of the central region of the crossbar; a right-side inner hole adjacent a right side of the central region of the crossbar; a left-side rope extending through the left-side outer hole; a right-side rope extending through the right-side outer hole; and rings attached at distal ends, relative to the crossbar, of the left-side rope and the right-side rope, wherein proximate ends of the left-side rope and the right-side rope have a shape with a diameter larger than a diameter of the left-side outer hole and the right-side outer hole, thereby preventing the proximate ends to be removed from the left-side outer hole and the right-side outer hole.

Embodiments of the present invention further provide a walking child support device comprising a crossbar having a central region and ends extending from the central region; a left-side outer hole extending through the crossbar on a left-side end thereof; a right-side outer hole extending through the crossbar on a right-side end thereof; a left-side inner hole, formed in a double keyhole shape, adjacent a left side of the central region of the crossbar; a right-side inner hole, formed in a double keyhole shape, adjacent a right side of the central region of the crossbar; a left-side rope extending through the left-side outer hole; a right-side rope extending through the right-side outer hole; and rings attached to loops formed at distal ends, relative to the crossbar, of the left-side rope and the right-side rope, wherein proximate ends of the left-side rope and the right-side rope have a shape with a diameter larger than a diameter of the left-side outer hole and the right-side outer hole, thereby preventing the proximate ends to be removed from the left-side outer hole and the right-side outer hole.

Embodiments of the present invention also provide a method to assist a child to learn to walk using a walking child support device comprising gripping, by a user, a central region of a crossbar of the walking child support device, wherein the crossbar has ends extending from the central region, a left-side outer hole extending through the crossbar on a left-side end thereof, a right-side outer hole extending through the crossbar on a right-side end thereof, a left-side inner hole adjacent a left side of the central region of the crossbar, a right-side inner hole adjacent a right side of the central region of the crossbar; hanging a left-side ring from a left-side rope extending through and secured to the left-side outer hole; hanging a right-side ring from a right-side rope extending through and secured to the right-side outer hole; and directing the child to hold the rings that are supported by the crossbar which is supported by the user while the child walks, wherein proximate ends of the left-side rope and the right-side rope have a shape with a diameter larger than a diameter of the left-side outer hole and the right-side outer hole, thereby preventing the proximate ends to be removed from the left-side outer hole and the right-side outer hole.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
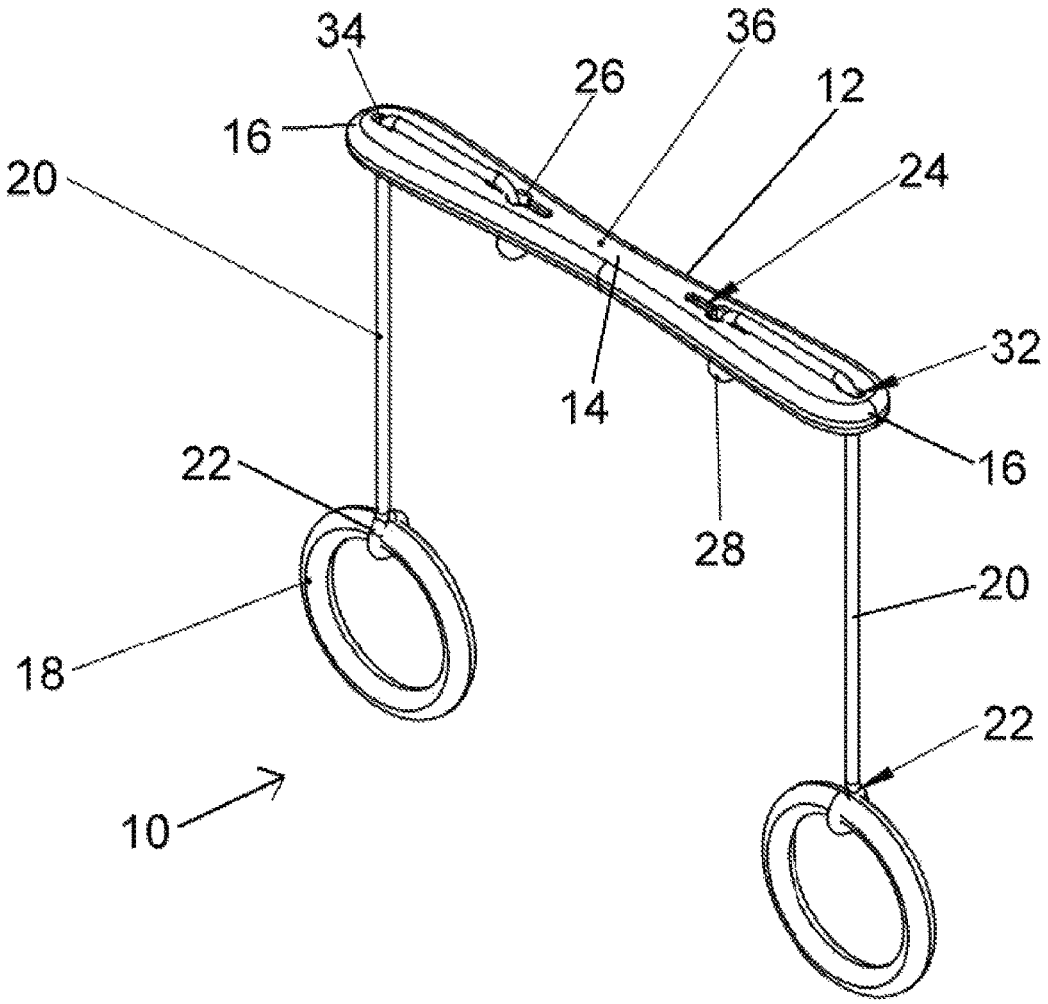
FIG. 1 illustrates a top perspective view of a walking child support device according to an exemplary embodiment of the present invention.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Figure 2:
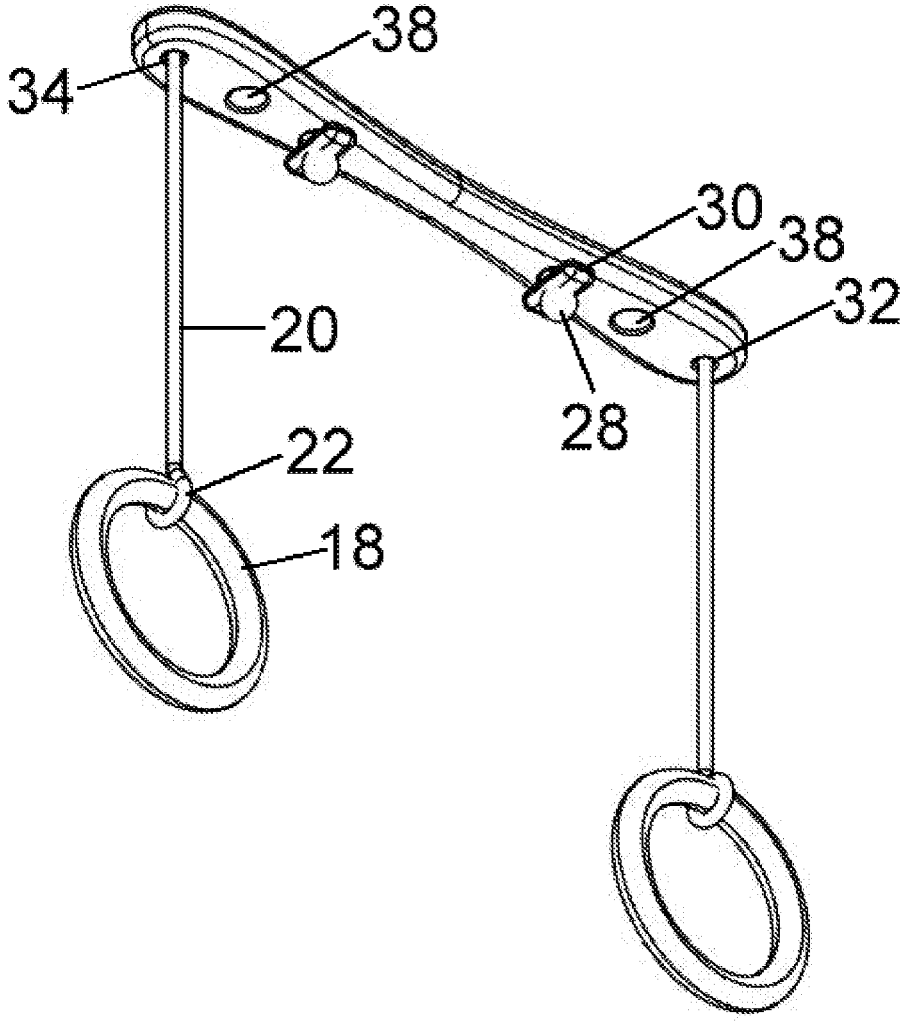
FIG. 2 illustrates bottom perspective view of the walking child support device of FIG. 1.
Figure 3:
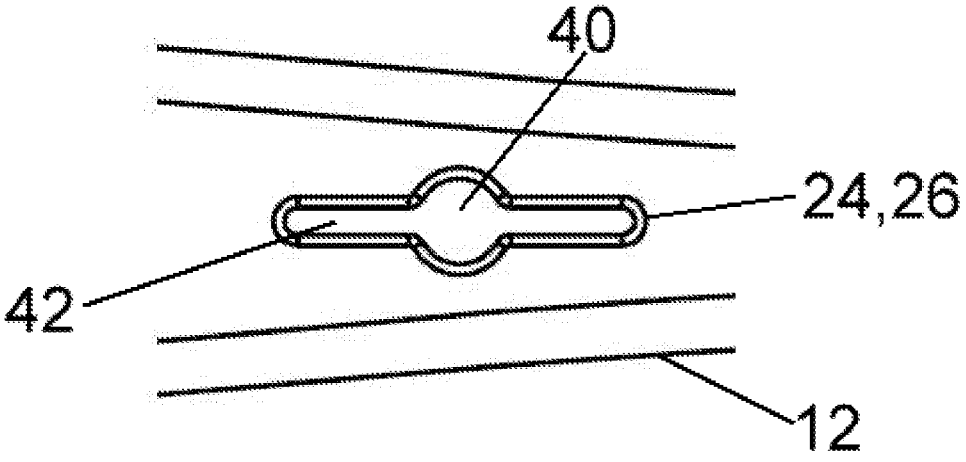
FIG. 3 illustrates a close-up view of a double keyhole feature of the crossbar of the walking child support device of FIG. 1.

Referring now to FIGS. 1 through 3, a walking child support device 10 can include a crossbar 12 having a central region 14 and ends 16 extending in opposite directions thereof. The central region 14 may be configured for a user to grip. To that end, the central region 14 may include a coating, such as a non-slip coating, or padding, or the like. In some embodiments, the central region 14 may be shaped for ease of gripping by, for example, finger indentations, or the like. The crossbar 12 may be made from various materials, such as non-toxic plastics, wood, metal, combinations thereof, or the like. In an exemplary embodiment, the crossbar 12 is made from natural wood either with no finish or with a food-grade finish The ends 16 and edges of the crossbar 12 may be rounded for comfort and safety. In some embodiments, the entire crossbar 12, except for the through holes, as described below, may be padded for safety should the child pull and the user lose their grip, for example.

The crossbar 12 may be made in various lengths. In some embodiments, the crossbar 12 may be from about 9 to about 14 inches long, from about 0.7 to about 1.5 inches wide and from about 0.4 to about 1.0 inch thick. Of course, other sizes are contemplated within the scope of the present invention.

A ring 18 may hang from each end 16 of the crossbar 12 via a rope 20. The rings 18 can be the same on each side of the crossbar 12 and can have an inside diameter from about 2 to about 4 inches and an outside diameter from about 3 to about 5 inches, for example. The thickness of the rings 18 may be from about 0.4 to about 0.75 inches, for example. Of course, other sizes may be used within the scope of the present invention. The rings 18 can be sized to easily allow a child to grasp them and may be strong enough to support the child's weight. The rings 18 may be smooth and have rounded edges to provide a secure and comfortable grip for the child.

The rings 18 may be made from various materials and may be the same or different form that of the crossbar 12. While the rings 18 are shown as round rings, other shapes may be used within the scope of the present invention. For example, the rings 18 may be D-shaped rings. In some embodiments, the rings 18 may include other open shapes, such as L-shaped, T-shaped, or the like.

The rope 20 may be used to provide attachment between the rings 18 and the crossbar 12. The rope 20 may be strong enough to support the weight of the child and can be made from various materials, including natural materials as well as synthetic materials. While the term "rope" is used herein, such term can include rope, webbing, twine, string, an elongated flexible, semi-rigid, or rigid member, or the like. In some embodiments, the rope may be formed integrally as a one-piece unit with the ring and the crossbar. In other embodiments, the rope may be covered with a tubular member that may be, for example, semi-rigid. In this embodiment, with the tubular member in place over the rope, the rope may still flex at the ring and the crossbar connections (for flexibility and portability), but may not form a loop. In other embodiments, the rope may be segmented with, for example, a flexible rope portion interconnected to a more rigid member, such as an elongated plastic or wood member.

The rope 20 may attach to the rings 18 with a loop 22 in such a way that the rings 18 cannot fall off or be easily removed, but where the rings 18 are allowed to rotate freely. Allowing the rings to rotate freely means that the child can grasp the rings on the side and their hand will rotate their grip on the rings to the bottom, which is the ideal position for a secure and comfortable grip. However, in some embodiments, the rope 20 may pass through a hole formed in the rings 18, securing the rope 20 to the rings 18. However, in this embodiment, the rings 18 may not rotate as when the loop 22 is utilized.

The crossbar 12 may include a plurality of holes on each side of the central region 14. Adjacent the central region 14, on each side thereof, may be a right-side inner hole 24 and a left-side inner hole 26. The inner holes 24, 26 may be shaped as a keyhole shape, or, in some embodiments, as a double keyhole shape, as shown in FIG. 3. The double keyhole shape for the inner holes 24, 26 may provide for additional height adjustment features, as described in greater detail below.

The end of the rope 20 may have a knot 28 or other such feature, such as stitching, or the like, having a diameter greater than the narrow portion 42 of the keyhole shaped inner holes 24, 26, but smaller than the large, central hole 40 of the keyhole shaped inner holes 24, 26. In some embodiments, a block 30 may be disposed along the rope 20, adjacent the knot 28 as shown in FIG. 2. The block 30 may be designed to fit through the inner holes 24, 26 in one direction, but cannot pass in other orientations, thereby providing increased security in accidental removal of the knot 28 through the inner holes 24, 26.

The crossbar 12 can include a right-side outer holes 32 and a left-side outer hole 34 adjacent ends 16 thereof. The outer holes 32, 34 may be sized to prevent the knot 28 from passing therethrough. The distance between outer holes 32, 34 is also the distance between the rings 18 when the crossbar 12 is held in a horizontal configuration.

The ropes 20 may pass from the rings 18 through the outer holes 32, 34. In this configuration, the knot may be positioned at a top side 36 of the crossbar 12, adjacent each outer hole 32, 34. This provides the longest configuration for the rope 20. In other words, this configuration provides the greatest distance between the crossbar 12 and the rings 18, which is useful for tall users or shorter children.

In some embodiments, the ropes may pass from the rings 18 through the outer holes 32, 34 and extend over the top side 36 of the crossbar 12 and back through the inner holes 24, 26. Depending on which inner hole 24, 26 each rope 20 passes, two sizes can be realized. First, if the right side rope passes through the right side outer hole 32 and then through the right side inner hole 24 (and similarly, the left side rope passes through the left side outer hole 34 and then through the left side inner hole 26), a medium length can be achieved, where the rings 18 are closer to the crossbar 12 than the embodiment described in the preceding paragraph. An even shorter length can be achieved by passing the right side rope through the right side outer hole 32 and then through the left side inner hole 26 (and similarly, the left side rope passes through the left side outer hole 34 and then through the right side inner hole 24), where the ropes pass over the central region 14. Thus, the present invention provides at least three sizes, where the size refers to the distance from the rings 18 to the crossbar 12. For this third embodiment (with the shortest size), the double keyhole shape for the inner holes 24, 26 is useful, as the knot 28 is positioned behind one side of the double keyhole (where, in the medium length size, the knot 28 is positioned behind the other side of the double keyhole).

Referring specifically to FIG. 2, in some embodiments, a central hole 38 may be disposed between the inner holes 24, 26 and the outer holes 32, 34. The central hole 38 may be round, as shown, may be a double keyhole shape, or some other suitable shape. With the presence of the central hole 38 on each side of the crossbar 12, five size adjustments may be realized.

While the above describes gripping the crossbar 12 directly by the user, in some embodiments, an extension (not shown) may extend above the top side 36 of the crossbar 12 to provide a handle for the user. Such an extension may be useful, for example, by providing a consistent handle size, regardless of whether the ropes cross by the central region 14 of the crossbar 12.

Embodiments of the present invention provide several features. For example, embodiments of the present invention provide 1) the ability to adjust the distance between the crossbar and the rings; 2) self-locating rings that move into the optimal position regardless of where the child initially grasps them; 3) portability, where embodiments of the present invention an collapse into a very small envelope size that easily fits in most purses, handbags, backpacks, and the like; 4) ease-of-use, requiring no setup, straps, harness or preparation, the user simply holds the crossbar and allows the child to grasp the rings; and 5) grasping skills training.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A walking child support device comprising:

a crossbar having a central region and a left-side end and a right-side end extending from the central region;

a left-side outer hole extending through the crossbar on the left-side end thereof;

a right-side outer hole extending through the crossbar on the right-side end thereof;

a left-side inner hole adjacent to a left side of the central region of the crossbar;

a right-side inner hole adjacent to a right side of the central region of the crossbar;

a left-side rope extending through the left-side outer hole;

a right-side rope extending through the right-side outer hole; and rings respectively attached at respective distal ends, relative to the crossbar, of the left-side rope and the right-side rope;

wherein proximal ends of the left-side rope and the right-side rope respectively have a shape with a diameter larger than a diameter of the left-side outer hole and the right-side outer hole, thereby preventing the proximal ends of the left-side rope and the right-side rope to be respectively removed from the left-side outer hole and the right-side outer hole;

wherein the left-side inner hole and the right-side inner hole are each formed in a double keyhole shape, wherein an enlarged central region of each double keyhole shape has a diameter larger than a diameter of the shape at the respective proximal ends of the left-side rope and the right-side rope, and wherein each double keyhole shape has a pair of elongated linear regions extending outwardly from opposite ends of the enlarged central region along a substantially longitudinal axis of the crossbar.

2. The walking child support device of claim 1, further comprising a loop formed at the respective distal ends of the left-side rope and the right-side rope, the loop fitting onto the respective rings and permitting the rings to move respectively relative to the loop.

3. The walking child support device of claim 1, wherein the shape of the respective proximal ends of the left-side rope and the right-side rope includes a block respectively disposed at the proximal ends of the left-side rope and the right-side rope.

4. The walking child support device of claim 1, further comprising a first central hole disposed between the left-side inner hole and the left-side outer hole, and a second central hole disposed between the right-side inner hole and the right-side outer hole.

5. The walking child support device of claim 1, wherein the shape of the respective proximal ends of the left-side rope and the right-side rope is formed by a knot, respectively, in the left-side rope and the right-side rope.

6. A walking child support device comprising:

a crossbar having a central region and a left-side end and a right-side end extending from the central region;

a left-side outer hole extending through the crossbar on the left-side end thereof;

a right-side outer hole extending through the crossbar on the right-side end thereof;

a left-side inner hole, formed in a left double keyhole shape, adjacent to a left side of the central region of the crossbar;

a right-side inner hole, formed in a right double keyhole shape, adjacent to a right side of the central region of the crossbar;

a left-side rope extending through the left-side outer hole;

a right-side rope extending through the right-side outer hole; and rings respectively attached to respective loops formed at respective distal ends, relative to the crossbar, of the left-side rope and the right-side rope;

wherein proximal ends of the left-side rope and the right-side rope respectively have a shape with a diameter larger than a diameter of the left-side outer hole and the right-side outer hole, thereby preventing the proximal ends of the left-side rope and the right-side rope to be respectively removed from the left-side outer hole and the right-side outer hole; wherein the left and right double keyhole shapes each have an enlarged central region with a diameter larger than a diameter of the shape at the respective proximal ends of the left-side rope and the right-side rope, and wherein the left and right double keyhole shapes each have a pair of elongated linear regions extending outwardly from opposite ends of the enlarged central region along a substantially longitudinal axis of the crossbar.

7. The walking child support device of claim 6, wherein the shape of the respective proximal ends of the left-side rope and the right-side rope includes a block respectively disposed at the proximal ends of the left-side rope and the right-side rope.

8. The walking child support device of claim 6, further comprising a first central hole disposed between the left-side inner hole and the left-side outer hole, and a second central hole disposed between the right-side inner hole and the right-side outer hole.

9. The walking child support device of claim 6, wherein the shape of the respective proximal ends of the left-side rope and the right-side rope is respectively is formed by a knot, respectively, in the left-side rope and the right-side rope.

10. A method to assist a child to learn to walk using a walking child support device, the method comprising:

gripping, by a user, a central region of a crossbar of the walking child support device, wherein the crossbar has a left-side end and a right-side end extending from the central region, a left-side outer hole extending through the crossbar on the left-side end thereof, a right-side outer hole extending through the crossbar on the right-side end thereof, a left-side inner hole adjacent to a left side of the central region of the crossbar, a right-side inner hole adjacent to a right side of the central region of the crossbar;

hanging a left-side ring from a left-side rope extending through and secured to the left-side outer hole;

hanging a right-side ring from a right-side rope extending through and secured to the right-side outer hole; and directing the child to hold the rings that are supported by the crossbar which is supported by the user while the child walks;

wherein proximal ends of the left-side rope and the right-side rope respectively have a shape with a diameter larger than a diameter of the left-side outer hole and the right-side outer hole, thereby preventing the proximal ends of the left-side rope and the right-side rope to be respectively removed from the left-side outer hole and the right-side outer hole;

wherein the left-side inner hole and the right-side inner hole are each formed in a double keyhole shape, wherein an enlarged central region of each double keyhole shape has a diameter larger than the diameter of the shape at the respective proximal ends of the left-side rope and the right-side rope, and wherein each double keyhole shape has a pair of elongated linear regions extending outwardly from opposite ends of the enlarged central region along a substantially longitudinal axis of the crossbar.

11. The method of claim 10, further comprising allowing the rings to respectively rotate about a loop respectively formed at the distal ends of the left-side rope and the right-side rope.

12. The method of claim 3, further comprising adjusting a distance from the rings to the crossbar by moving the shape of the left-side rope through the enlarged central region of the left-side inner hole and moving the shape of the right-side rope through the enlarged central region of the right-side inner hole.

13. The method of claim 11, further comprising adjusting a distance from the rings to the crossbar by moving the shape of the left-side rope through the enlarged central region of the right-side inner hole and moving the shape of the right-side rope through the enlarged central region of the left-side inner hole.

14. The method of claim 10, wherein the shape of the respective proximal ends of the left-side rope and the right-side rope includes a block respectively disposed at the proximal ends of the left-side rope and the right-side rope.

15. The method of claim 10, wherein the crossbar further comprises a first central hole disposed between the left-side inner hole and the left-side outer hole, and a second central hole disposed between the right-side inner hole and the right-side outer hole.

16. The method of claim 10, wherein the shape of the respective proximal ends of the left-side rope and the right-side rope is formed by a knot, respectively; in the left-side rope and the right-side rope.

* * * * *